US012480715B2

(12) United States Patent
Ariyama et al.

(10) Patent No.: US 12,480,715 B2
(45) Date of Patent: Nov. 25, 2025

(54) HEAT EXCHANGER

(71) Applicants: MAHLE International GmbH, Stuttgart (DE); MAHLE Filter Systems Japan Corporation, Tokyo (JP)

(72) Inventors: Masahiro Ariyama, Tokyo (JP); Ryoichi Kurihara, Tokyo (JP); Takuma Shibata, Tokyo (JP); Satoshi Suzuki, Tokyo (JP); Kenji Wada, Tokyo (JP); Kenji Yamashita, Tokyo (JP)

(73) Assignees: Mahle International GmbH (DE); MAHLE Japan Ltd. (JP)

( * ) Notice: Subject to any disclaimer, the term of this patent is extended or adjusted under 35 U.S.C. 154(b) by 201 days.

(21) Appl. No.: 18/124,996

(22) Filed: Mar. 22, 2023

(65) Prior Publication Data

US 2023/0332837 A1 Oct. 19, 2023

(30) Foreign Application Priority Data

Mar. 22, 2022 (JP) ..... 2022-045878

(51) Int. Cl.
*F28D 9/00* (2006.01)
*F28F 3/08* (2006.01)
(Continued)

(52) U.S. Cl.
CPC ..... *F28D 9/0075* (2013.01); *F28D 9/005* (2013.01); *F28D 9/0068* (2013.01); *F28F 3/086* (2013.01); *F28D 2021/0049* (2013.01); *F28F 3/027* (2013.01); *F28F 2245/00* (2013.01); *F28F 2275/04* (2013.01)

(58) Field of Classification Search
CPC ..... F28D 9/005; F28D 9/0075; F28D 9/0068; F28D 9/0043; F28F 2250/004; F28F 3/086
See application file for complete search history.

(56) References Cited

U.S. PATENT DOCUMENTS 5,222,551 A * 6/1993 Hasegawa ..... F28F 3/046 165/166
5,913,361 A * 6/1999 Engstrom ..... F28D 9/005 165/70

(Continued)

FOREIGN PATENT DOCUMENTS

JP 2003194489 A * 7/2003 ..... F28D 9/005

*Primary Examiner* — Jianying C Atkisson
*Assistant Examiner* — For K Ling
(74) *Attorney, Agent, or Firm* — Fishman Stewart PLLC

(57) ABSTRACT

A heat exchanger may include a stacked plurality of plates and a fin plate brazed to each other. Each set of adjacent said plates of the plurality of the plates may define a flow path between plates. Each plurality of the plates may include a flow-through portion penetrating through the plates and through which a fluid is flowable. At least one set of the flow-through portions may be provided at one of the flow paths such that the fluid is flowable from one side of a flow-through portion to an other side of a flow-through portion. The flow-through portion may be disposed outside the fin plate. Each plurality of the plates may further include a through hole disposed outside the fin plate. Each plurality of the plates may further include a first boss portion formed in a substantially elliptical shape surrounding the flow-through portion and the through hole.

20 Claims, 9 Drawing Sheets

(51) Int. Cl.
*F28D 21/00* (2006.01)
*F28F 3/02* (2006.01)

(56) References Cited

U.S. PATENT DOCUMENTS

| | | | | | |
|---|---|---|---|---|---|
| 5,992,510 | A * | 11/1999 | Kallrot | F28D 9/005 | 165/167 |
| 6,164,371 | A * | 12/2000 | Bertilsson | F28D 9/0093 | 165/140 |
| 7,469,554 | B2 * | 12/2008 | Martins | F28D 9/005 | 62/506 |
| 2006/0032621 | A1 * | 2/2006 | Martin | F28F 9/026 | 165/167 |
| 2008/0264618 | A1 * | 10/2008 | Richter | F28D 9/005 | 165/166 |
| 2010/0181055 | A1 * | 7/2010 | Yamada | F28D 9/005 | 165/167 |
| 2012/0267084 | A1 * | 10/2012 | Crawford | F28F 3/005 | 165/170 |
| 2017/0176065 | A1 * | 6/2017 | Kuroda | F28F 3/08 | |
| 2017/0184347 | A1 * | 6/2017 | Ariyama | F28D 9/005 | |
| 2018/0094870 | A1 * | 4/2018 | Ariyama | F28D 9/0075 | |
| 2021/0254907 | A1 * | 8/2021 | Nita | F28F 13/12 | |
| 2022/0026159 | A1 * | 1/2022 | Schumacher | F28D 9/005 | |

* cited by examiner

HEAT EXCHANGER

CROSS-REFERENCE TO RELATED APPLICATIONS

This application claims priority to Japanese Patent Application No. JP 2022-045878, filed on Mar. 22, 2022, the contents of which is hereby incorporated by reference in its entirety.

TECHNICAL FIELD

The present invention relates to a heat exchanger.

BACKGROUND

A heat exchanger where heat is exchanged between a plurality of fluids is utilized as a water-cooled type oil cooler in which a lubricating oil of an internal combustion engine is cooled by means of a refrigerant such as, for example, a long-life coolant (LLC). A heat exchanger in which a pair of oil passage holes is positioned across a first and a second fin plate in a direction following along a first reference line and a pair of coolant passage holes is positioned across a first and a second fin plate in a direction following along a first reference line, is known (refer, for example, to Patent Literature 1).

CITATION LIST

Patent Literature

[Patent Literature 1] JP Patent Appl. Publ. No. 2018-54265

As seen in a plan view, in the heat exchanger of Patent Literature 1, a fin is disposed in between a pair of oil passage holes and coolant passage holes formed on a diagonal line; in other words, a fin is disposed at the portion where a fluid port is not provided. Thus, while the fin and core plate were brazed and sufficient brazing strength is obtainable at the portion where the fin is disposed, at the perimeters of the fluid port portions where the fin is not disposed, the spatial portion, which does not contribute to brazing strength except for the portions where the ports were brazed, had become large.

Thus, compared to common heat exchanger configurations where a fin is disposed at the entire surface of a core plate, the strength is reduced at the perimeter of a fluid port portion, in particular a plate flat portion, due to having no support structure to oppose plate deformation. Hence, when the heat exchanger expanded on the whole due to internal pressure occurring inside the heat exchanger having risen by a fluid, there was room for improvement for the pressure-resisting strength of the spatial portion of the perimeter of a fluid port portion.

Thus, in consideration of the above-mentioned problem, the objective of the present invention is to improve the strength of a heat exchanger.

SUMMARY

In order to solve the aforementioned problem, the heat exchanger according to the present invention comprises a stacked plurality of plates and a fin plate brazed to each other, where: each set of adjacent said plates of the plurality of the plates demarcates a flow path between plates such that fluid flows therebetween; each plurality of the plates has a flow-through portion penetrating through the plates through which a fluid flows, and at least one set of the flow-through portion is provided at one of the flow paths between plates, so as to enable the fluid to flow from one side of a flow-through portion to an other side of a flow-through portion: the flow-through portion is provided in a position outside the fin plate, across the fin plate as seen in a plan view; each plurality of the plates further comprises a through hole at position outside the fin plate, across the fin plate as seen in a plan view; and a plurality of the plates comprises a first boss portion formed in a substantially elliptical shape surrounding the flow-through portion and the through hole, the first boss portion being formed so as to protrude from each of the plates adjacent in a stacking direction until abutting each other.

In this mode, when the plates are brazed, a large brazing area can be ensured due to the first boss portion having a large contour. Further, the first boss portions adjacent in the stacking direction are brazed and hence there is no space therebetween, and a plate flat portion does not exist between the flow-through portion and through hole across a space. Thus, deformation by pressure being applied to the plate flat portion due to fluid pressure can be prevented. Therefore, plate deformation due to expansion of the heat exchanger when internal pressure rises can be suppressed, and the strength of the heat exchanger can be improved.

Furthermore, two sets of the flow-through portion are provided, where: one side of a set of the flow-through portions is provided on an inner side of an outer periphery edge of the first boss portion, as seen in a plan view: another side of a set of the flow-through portions is provided on an outer side of an outer periphery edge of the first boss portion; and the other side of a set of the flow-through portions is formed extending widely in a substantially extending direction of the first boss portion, and a second boss portion may be formed at a perimeter thereof, the second boss portion being formed so as to protrude until abutting with the plate adjacent to an outer periphery edge of the first boss portion as seen in a plan view, and adjacent in a stacking direction in a direction opposite to the first boss portion.

In this configuration, the first boss portion and second boss portion are continuous as seen in a plan view, and the plate flat portion can be configured so as not to exist in between the first boss portion and second boss portion across a space. Thus, the plate flat portion of the perimeter of a fluid port can be eliminated, and the strength of the heat exchanger can be better improved.

The through hole may comprise a third boss portion formed so as to protrude in a reverse direction to the first boss portion, until abutting with the adjacent plate. In this configuration, because the third boss portions are coupled in the stacking direction to form a columnar, the perimeters of the flow-through portions adjacent to the through holes are supported and deformation strength can be raised.

Advantageous Effects of Invention

The strength of a heat exchanger can be improved by the present invention.

DETAILED DESCRIPTION

Figure 1:
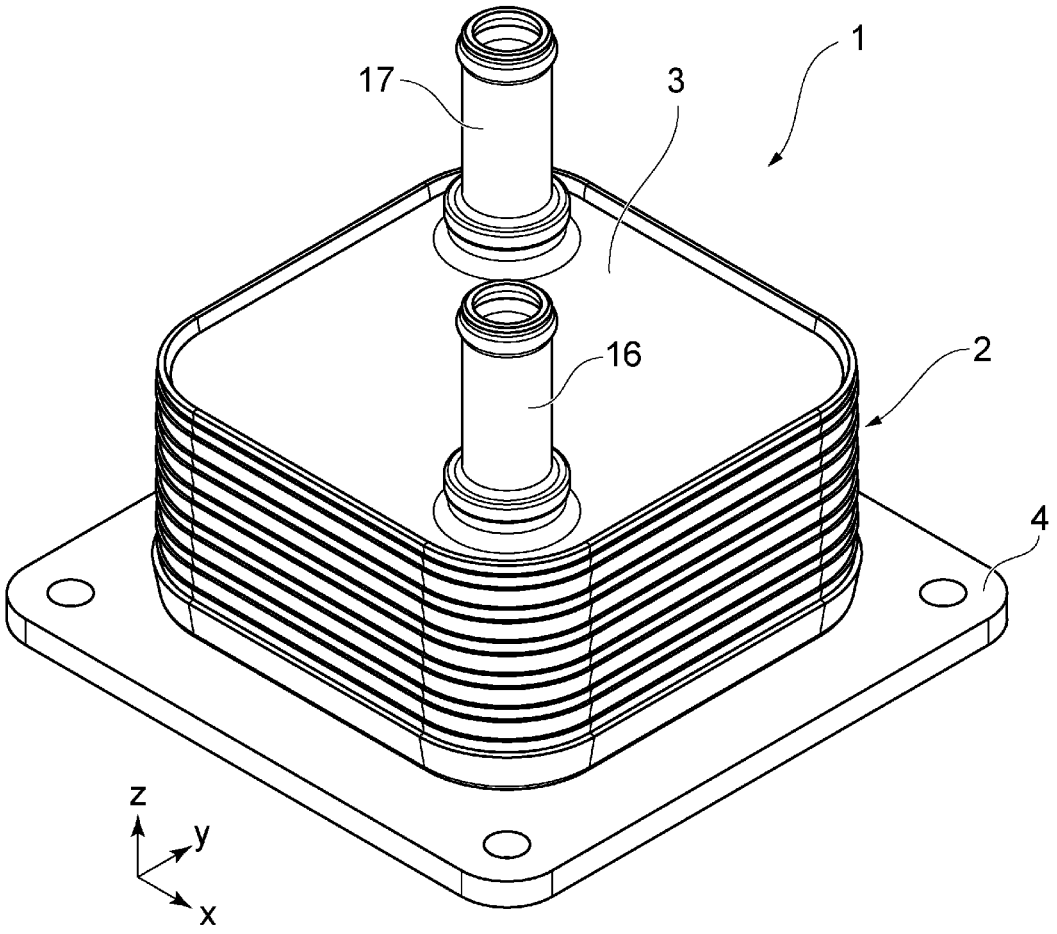
FIG. 1 is a perspective view of an oil cooler according to an embodiment.

An embodiment of the present invention will be explained as follows, with reference to the drawings. In the below embodiment, an example will be explained in which the heat exchanger according to the present invention is utilized as a water-cooled type oil cooler in which a lubricating oil of an internal combustion engine is cooled by means of a refrigerant such as a long-life coolant (LLC).

Firstly, an oil cooler 1, which is an embodiment of the heat exchanger of the present invention, is explained. As illustrated in FIGS. 1 to 9, oil cooler 1 comprises a stacked plurality of plates (first core plates 5, second core plates 6). Each adjacent set of these pluralities of first core plates 5 and second core plates 6 demarcates flow paths between plates (oil flow path between plates 7 and coolant flow path between plates 8) such that fluid flows therebetween. Each plurality of first core plates 5 and second core plates 6 has flow-through portions (oil passage hole 11, coolant passage hole 12) penetrating through the first core plate 5 and second core plate 6 through which a fluid flows. At least one set of the flow-through portions is provided at one of the flow paths between plates so as to enable the fluid to flow from one side of the flow-through portion to the other side of the flow-through portion. Each of the plurality of the first core plate 5 and the second core plate 6 further comprises a through hole 13, where the through hole 13 comprises a third boss portion (boss portions 23, 26) formed so as to protrude from each adjacent first core plate 5 and second core plate 6 until abutting with each other. The flow-through portion comprises a first boss portion (boss portions 21, 24) formed so as to protrude from each adjacent plates until abutting with each other, where the first boss portion surrounds the third boss portion, and the first boss portion is adjacent to the flow-through portion where the third boss portion and the first boss portion are provided. The oil cooler 1 according to the present embodiment will be specifically explained as follows.

For convenience of explanation below, of the directions following along the surfaces of the first core plate 5, second core plate 6, upper side first core plate 5U and lower side first core plate 5L of the oil cooler 1 in FIGS. 1 to 9, one direction following along the x-axis (left-right direction) is configured as the x-direction, and the other direction following along the y-axis (front-back direction) is configured as the y-direction. Moreover, the direction following along the z-axis direction, which is orthogonal to the x-axis and y-axis in oil cooler 1 (z-direction), is configured as the up-down direction or the stacking direction of the first core plate 5, second core plate 6, upper side first core plate 5U, and lower side first core plate 5L. The below explanation of the positional relationship and direction of each constituent element as a right side, left side, front side, back side, upper side, lower side, top portion, bottom portion etc. merely illustrates the positional relationship and direction in the drawings, and there is no limitation on positional relationships and directions in an actual heat exchanger.

Figure 2:
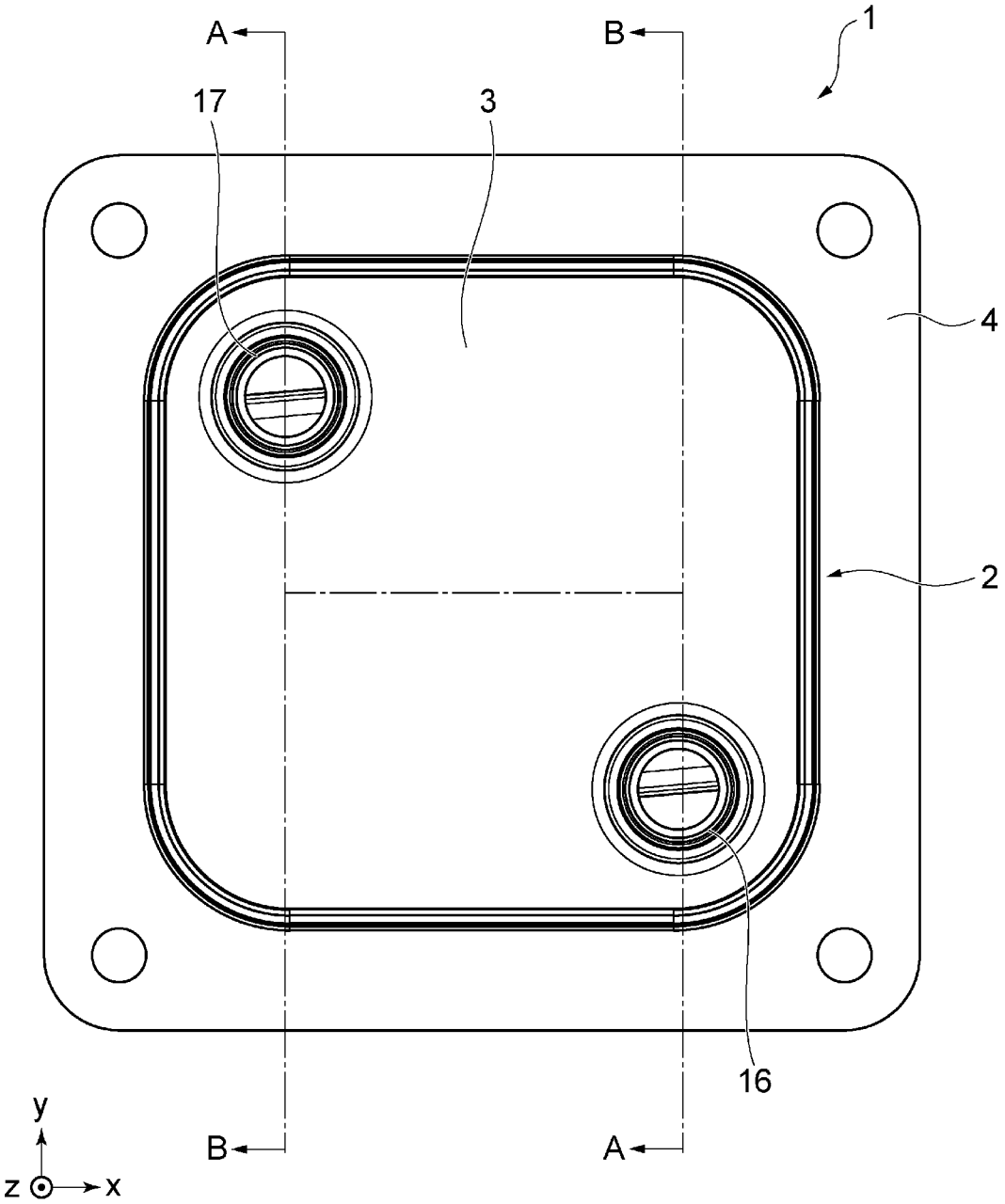
FIG. 2 is a plan view of an oil cooler according to an embodiment.
Figure 3:
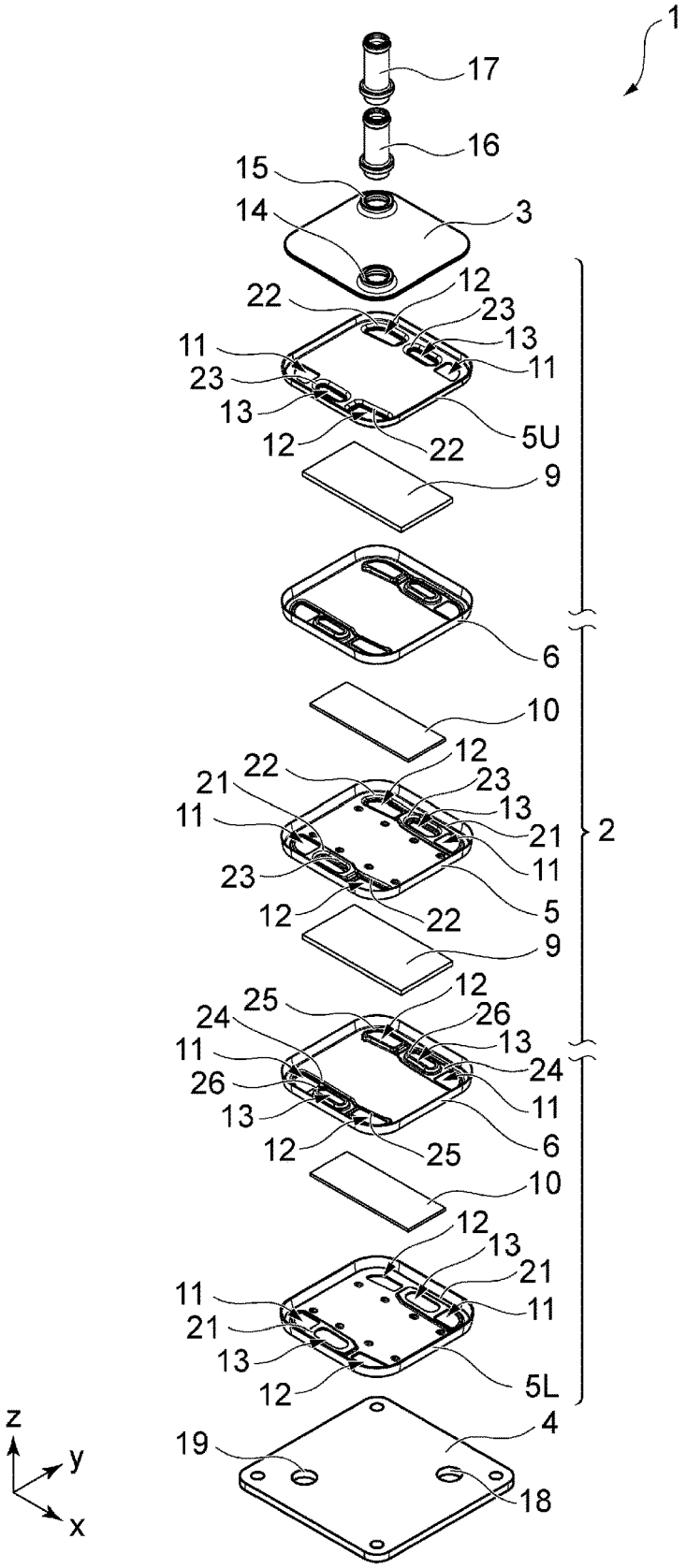
FIG. 3 is an exploded perspective view of an oil cooler according to an embodiment.
Figure 4:
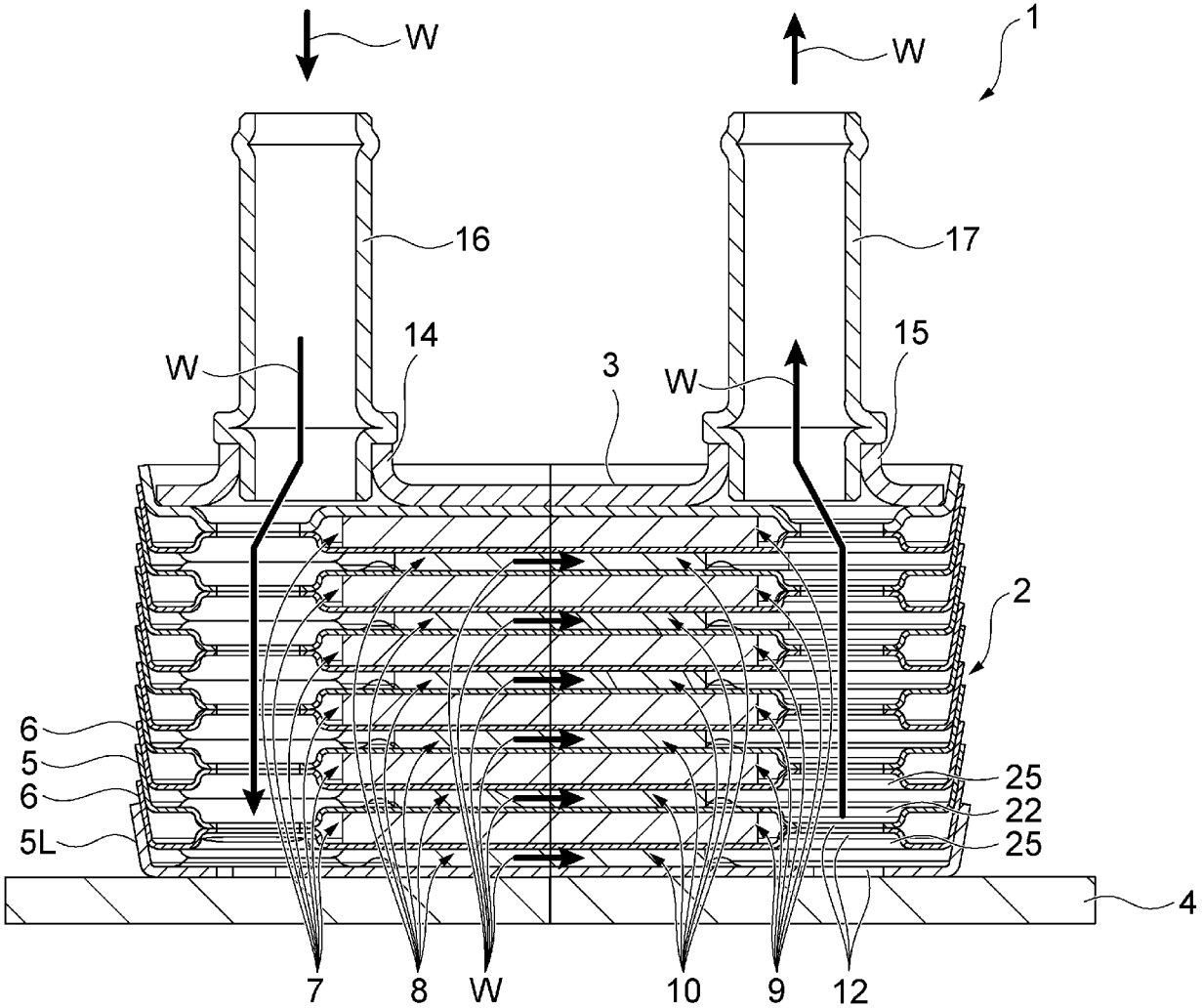
FIG. 4 is a cross sectional view of an oil cooler according to an embodiment, taken along A-A.
Figure 5:
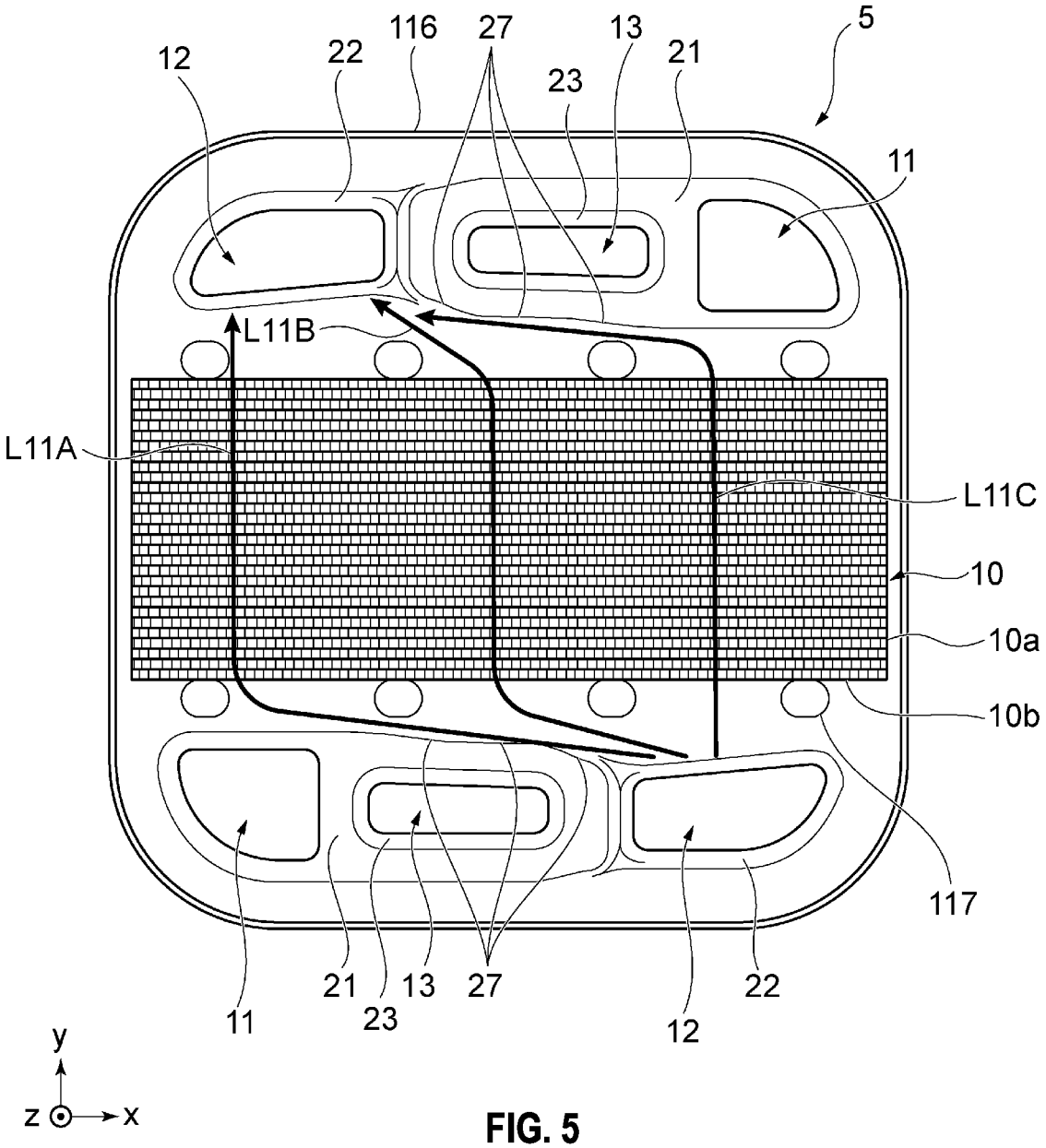
FIG. 5 is a plan view of a first core plate of an oil cooler according to an embodiment.
Figure 6:
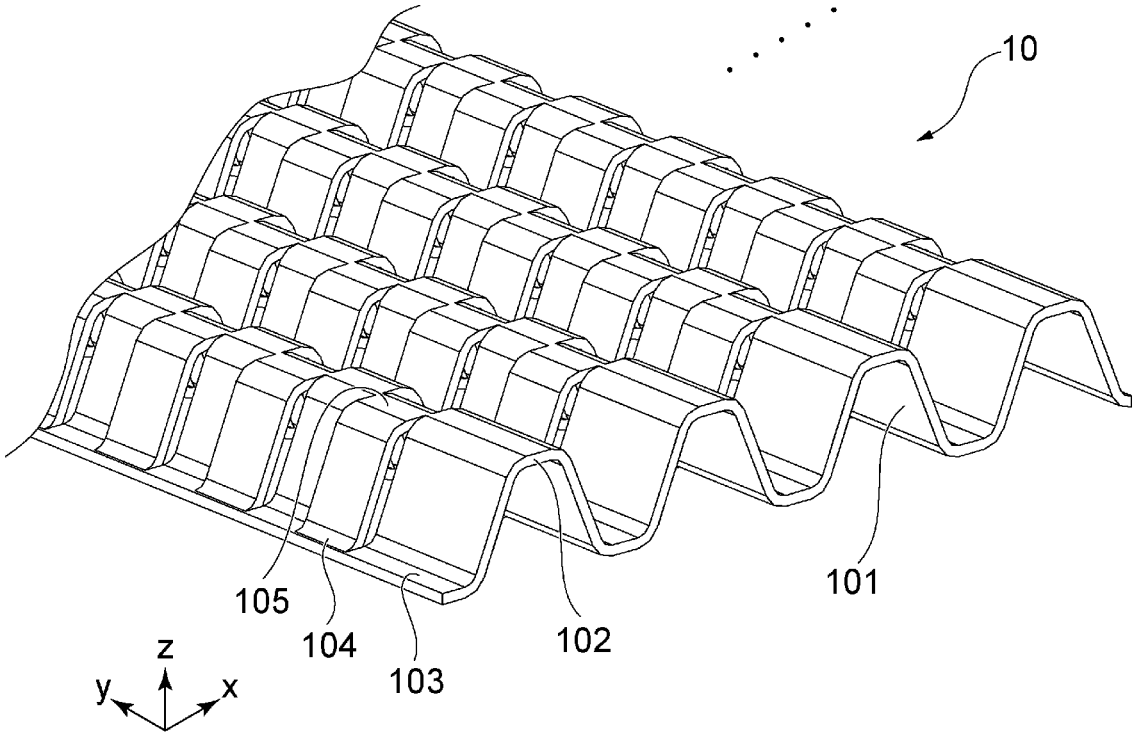
FIG. 6 is an enlarged perspective view of a second fin plate of an oil cooler according to an embodiment.
Figure 7:
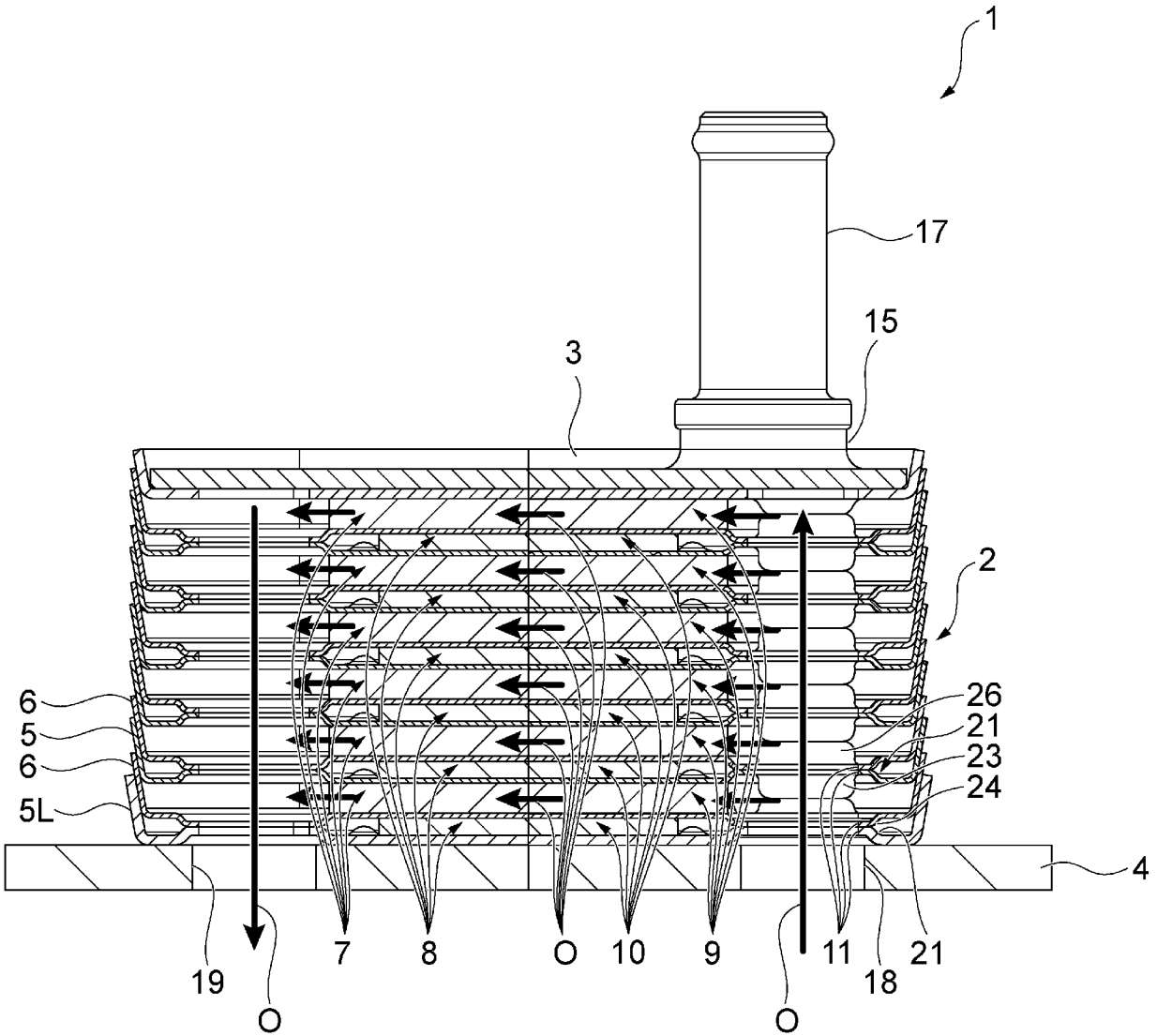
FIG. 7 is a cross sectional view of an oil cooler according to an embodiment, taken along B-B.
Figure 8:
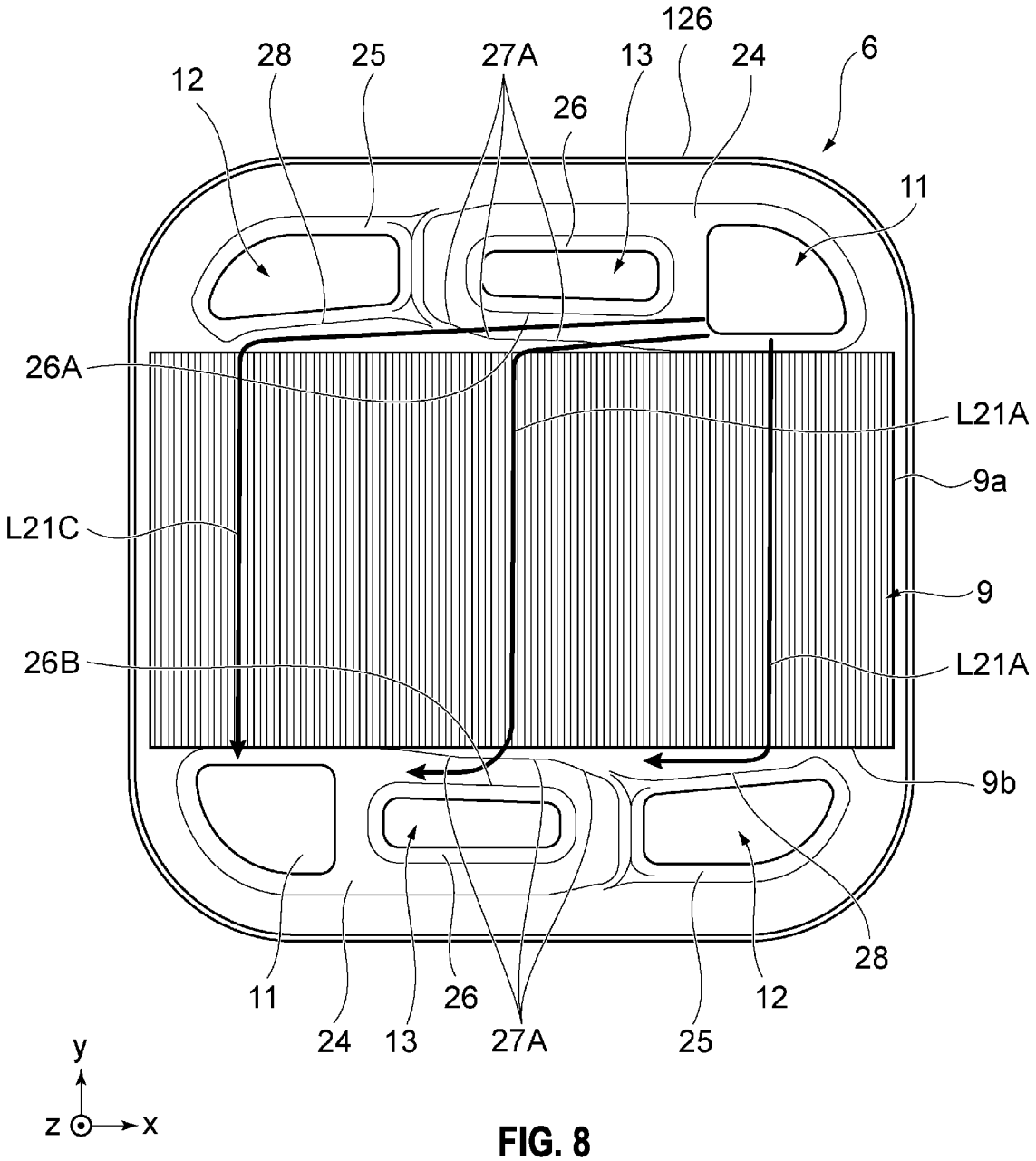
FIG. 8 is a plan view of a second core plate of an oil cooler according to an embodiment.
Figure 9:
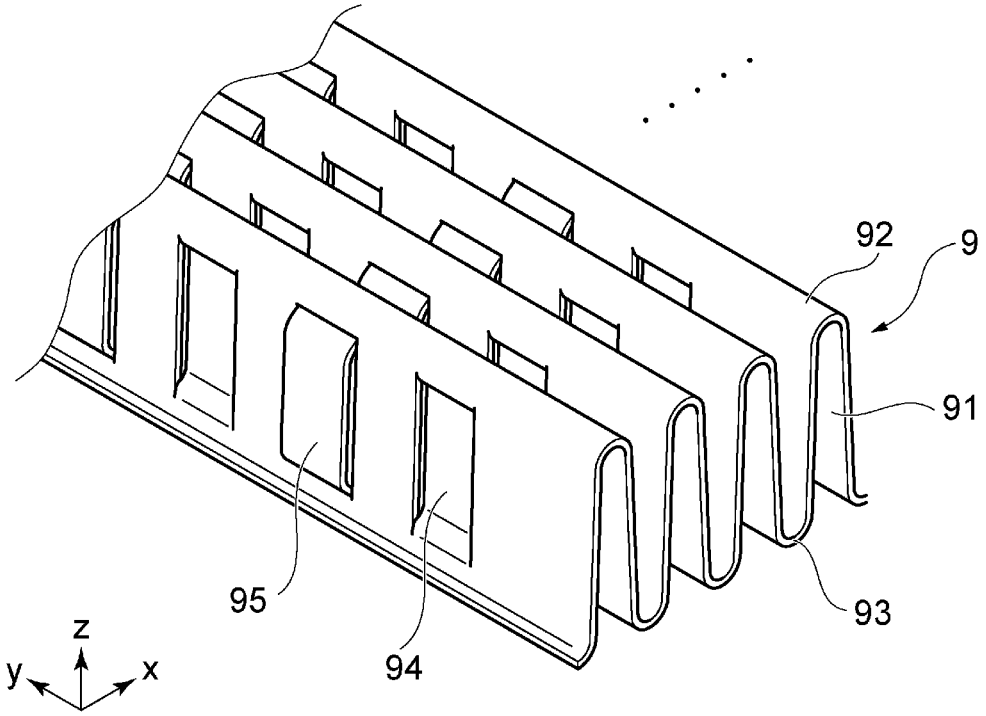
FIG. 9 is an enlarged perspective view of a first fin plate of an oil cooler according to an embodiment.

FIG. 1 is a perspective view of oil cooler 1. Moreover, FIG. 2 is a plan view of oil cooler 1. Moreover, FIG. 3 is an exploded perspective view of oil cooler 1. FIG. 4 is a cross sectional view of FIG. 2 taken along A-A. FIG. 5 is a plan view illustrating a state in which the second fin plate 10 is mounted to the first core plate 5 of oil cooler 1. FIG. 6 is an enlarged perspective view of the second fin plate 10 of oil cooler 1. FIG. 7 is a cross sectional view of FIG. 2 taken along B-B. FIG. 8 is a plan view illustrating a state in which a first fin plate 9 is mounted to the second core plate 6 of oil cooler 1. FIG. 9 is an enlarged perspective view of the first fin plate 9 of oil cooler 1. The gist of oil cooler 1 as a heat exchanger in a first example of the present invention will be explained by way of FIGS. 1 to 9.

As illustrated in FIGS. 1 to 3, oil cooler 1 is roughly configured from the heat exchange portion 2 where heat is exchanged between oil configured as a first fluid and coolant configured as a second fluid, a top plate 3 affixed to the upper face of the heat exchange portion 2, a bottom plate 4 affixed to the lower face of the heat exchange portion 2, a coolant introduction pipe 16, and a coolant discharge pipe 17.

In the heat exchange portion 2, first core plates 5 configured as a plurality of plates and second core plates 6 configured as a plurality of plates being in closely similar basic shape are alternatingly stacked. Moreover, in the heat exchange portion 2, an oil flow path between plates 7 configured as a first flow path between plates (refer to FIG. 4 and FIG. 7) and a coolant flow path between plates 8 configured as a second flow path between plates (refer to FIG. 4 and FIG. 7) are alternatingly configured in between the first core plate 5 and second core plate 6. In oil cooler 1, multiple (for example, with the oil flow path between plates 7 and the coolant flow path between plates 8, six oil flow paths between plates 7 and six coolant flow paths between plates 8 are formed inside the heat exchange portion 2. Plates are stacked by repeatedly combining the first and second core plates 5, 6, and the first and second fin plates 9, 10; however, in FIG. 3, the display of repeating portions has been omitted midway.

As illustrated in FIG. 4 and FIG. 7, in oil cooler 1, the oil flow path between plates 7 is configured between the lower face of first core plate 5 and upper face of second core plate 6. Moreover, in oil cooler 1, the coolant flow path between plates 8 is configured between the upper face of first core plate 5 and lower face of second core plate 6. The first fin plate 9 is disposed at the oil flow path between plates 7. The second fin plate 10 is disposed at the coolant flow path between plates 8. In FIG. 3, FIG. 4 and FIG. 7, illustration of the shapes of the first fin plate 9 and second fin plate 10 has been omitted.

A plurality of first core plates 5, second core plates 6, top plate 3, bottom plate 4, a plurality of first fin plates 9 and a plurality of second fin plates 10 are integrally joined to each other by brazing. In more detail, the top plate 3, first core plate 5 and second core plate 6 are formed by using so-called cladded material, in which a brazing material layer is coated on the surface of an aluminum alloy base material. Each part is temporarily assembled at a predetermined position, and then heated in a furnace to thereby become integrally brazed.

The first core plate 5 and second core plate 6 are formed by press-forming a thin base metal of aluminum alloy to become a rectangular overall shape (substantially square).

The first core plate 5 and second core plate 6 comprise a pair of oil passage holes 11, 11 configured as a pair of first flow-through portions, and a pair of coolant passage holes 12, 12 configured as a pair of second flow-through portions.

Moreover, as illustrated in FIG. 3, FIG. 5 and FIG. 8, the first core plate 5 and second core plate 6 have a pair of through holes 13, 13 through which neither oil nor coolant pass through. As illustrated in FIG. 3, FIG. 4 and FIG. 7, although through holes 13 each communicate vertically, they do not communicate with the oil flow path between plates 7 or coolant flow path between plates 8. If providing a further flow-through portion for oil and coolant, for example if utilizing this as a turn circuit when employing a by-pass pathway or multi-path structure, these pair of through holes 13 are installed in order to connect the respective oil flow path between plates 7 and coolant flow path between plates 8. However, these are not utilized in the present embodiment.

The top plate 3 comprises a coolant introduction portion 14 which communicates with one side of the coolant passage hole 12 of the uppermost portion of the heat exchange portion 2, and a coolant discharge portion 15 which communicates with the other side of the coolant passage hole 12 of the uppermost portion of the heat exchange portion 2. As illustrated in FIG. 1, FIG. 3 and FIG. 4, a coolant introduction pipe 16 is connected to the coolant introduction portion 14. As illustrated in FIG. 1, FIG. 3 and FIG. 4, a coolant discharge pipe 17 is connected to the coolant discharge portion 15. The oil cooler 1 supplies coolant from the coolant introduction pipe 16, and discharges coolant from the coolant discharge pipe 17.

As illustrated in FIG. 3 and FIG. 7, the bottom plate 4 comprises an oil introduction portion 18 which communicates with one side of oil passage hole 11 of the lowermost part of the heat exchange portion 2, and an oil discharge portion 19 which communicates with the other side of oil passage hole 11 of the lowermost part of the heat exchange portion 2. Each of the oil introduction portion 18 and oil discharge portion 19 of the bottom plate 4 is affixed to a cylinder block (not shown) etc. via a sealing gasket (not shown) etc. The oil cooler 1 supplies oil from the oil introduction portion 18, and discharges oil from the oil discharge portion 19.

A pair of oil passage holes 11, 11 is positioned at the outer edges of the first core plate 5 and second core plate 6, and is formed in a symmetrical position across the center of the core plate. In further detail, as illustrated in FIG. 3, FIG. 5, FIG. 7 and FIG. 8, a pair of oil passage holes 11, 11 is positioned at the outer edges of the first core plate 5 and second core plate 6, and is formed in a symmetrical position on a diagonal line of the first core plate 5 and second core plate 6, across the center of the first core plate 5 and second core plate 6. The oil passage hole 11, as seen in a plan view of the second core plate 6, is provided in a position outside the first fin plate 9 (the side away from the center of the first fin plate 9 in the y-direction) across the first fin plate 9. The oil passage hole 11, as seen in a plan view of the first core plate 5, is provided in a position outside the second fin plate 10 (the side away from the center of the second fin plate 10 in the y-direction) across the second fin plate 10.

A pair of coolant passage holes 12, 12 is positioned at the outer edges of the first core plate 5 and second core plate 6, and is formed in a symmetrical position across the center of the first core plate 5 and second core plate 6. In further detail, as illustrated in FIG. 3, FIG. 4, FIG. 5 and FIG. 8, a pair of coolant passage holes 12, 12 is positioned at the outer edges of the first core plate 5 and second core plate 6, and is formed in a symmetrical position on a diagonal line of the first core plate 5 and second core plate 6, across the center of the first core plate 5 and second core plate 6. The coolant passage hole 12, as seen in a plan view of the second core plate 6, is provided in a position outside the first fin plate 9 (the side away from the center of the second fin plate 10 in the y-direction) across the first fin plate 9. The coolant passage hole 12, as seen in a plan view of the first core plate 5, is provided in a position outside the second fin plate 10 (the side away from the center of the second fin plate 10 in the y-direction) across the second fin plate 10.

The coolant passage hole 12 is formed so as not to overlap with oil passage hole 11. In further detail, coolant passage hole 12 is formed on a diagonal line of the first core plate 5 and second core plate 6, unlike the oil passage hole 11. The coolant passage hole 12 is formed in a widely extending substantially elliptical shape in a direction (substantially extending direction) extending at the end portion of the boss portions 21, 24 in the left-right direction (x-direction).

As illustrated in FIG. 3, FIG. 5 and FIG. 8, a pair of through holes 13, 13 are formed so as to be symmetrically positioned at the outer edges of the first core plate 5 and second core plate 6 across the centers of the first core plate 5 and second core plate 6, and so as to be positioned between oil passage hole 11 and coolant passage hole 12. The through hole 13, as seen in a plan view of the second core plate 6, is provided in a position outside the first fin plate 9 (the side away from the center of the first fin plate 9 in the y-direction) across the first fin plate 9. The through hole 13, as seen in a plan view of the first core plate 5, is provided in a position outside the second fin plate 10 (the side away from the center of the second fin plate 10 in the y-direction) across the second fin plate 10.

Moreover, coolant introduced from the coolant introduction portion 14 of top plate 3 flows through a coolant flow path between plates 8, flows inside the heat exchange portion 2 on the whole in a direction orthogonal to the stacking direction of the first core plate 5 and second core plate 6, and reaches the coolant discharge portion 15 of top plate 3. The W-arrow mark in FIG. 4 illustrates the flow of coolant. The oil introduced from the oil introduction portion 18 of the bottom plate 4 flows through the oil flow path between plates 7, flows inside the heat exchange portion 2 on the whole in a direction orthogonal to the stacking direction of the first core plate 5 and second core plate 6, and reaches the oil discharge portion 19 of the bottom plate 4. The O-arrow mark in FIG. 7 illustrates the flow of oil.

As illustrated in FIG. 3, FIG. 4, FIG. 5 and FIG. 7, in the first core plate 5, the perimeters of the oil passage hole 11 and through hole 13 are formed, as a boss portion 21, so as to protrude towards the side of the coolant flow path between plates 8 (upper side), where this perimeter abuts and is brazed with a boss portion 24 of the adjacent second core plate 6. Further, a perimeter of the coolant passage hole 12 is formed, as a boss portion 22, so as to protrude towards the side of the oil flow path between plates 7 (lower side); in other words, so as to protrude until abutting with the second core plate 6 adjacent to the opposite direction of the boss portion 21, where this perimeter abuts and is brazed with a boss portion 25 of the second core plate 6. In the first core plate 5, the oil passage hole 11 is provided at the inner side of an outer periphery edge of the boss portion 21, as seen in a plan view. Moreover, the coolant passage hole 12 is provided at the outer side of an outer periphery edge of the boss portion 21 in the first core plate 5. Moreover, as illustrated in FIG. 3, FIG. 5 and FIG. 7, at the first core plate 5, a perimeter of the through hole 13 is formed, as a boss portion 23, so as to protrude towards the side of the oil flow path between plates 7 (lower side), where this perimeter abuts and is brazed with a boss portion 26 of the adjacent second core plate 6. The boss portion 23 is the inner periphery side of the boss portion 21 and is formed at the outer periphery side of through hole 13.

Because of the relationships with the top plate 3 and bottom plate 4, the upper side first core plate 5U positioned at the uppermost portion of the heat exchange portion 2 and the lower side first core plate 5L positioned at the lowermost part of the heat exchange portion 2 have a configuration somewhat different to the other first core plates 5 positioned at the intermediate portion of the heat exchange portion 2. Specifically, no boss portion 22 and boss portion 23 are provided in the lowermost part of the lower side first core plate 5L, and only the boss portion 21 protruding towards the side of the coolant flow path between plates 8 (upper side) is provided. Moreover, no boss portion 21 is provided in the uppermost portion of the upper side first core plate 5U, but the boss portion 22 and boss portion 23 each protruding towards the side of the oil flow path between plates 7 (lower side) are provided.

As illustrated in FIG. 3, FIG. 4, FIG. 7 and FIG. 8, at the second core plate 6, the perimeters of the oil passage hole 11 and through hole 13 are formed, as a boss portion 24, so as to protrude towards the side of the coolant flow path between plates 8 (lower side), where these perimeters abut and are brazed with the boss portion 21 of the adjacent first core plate 5. Further, a perimeter of the coolant passage hole 12 is formed, as a boss portion 25, so as to protrude until abutting with the side of the oil flow path between plates 7 (upper side); in other words, so as to protrude until abutting with the first core plate 5 adjacent in the opposite direction of the boss portion 24, where this perimeter abuts and is brazed with the boss portion 22 of the first core plate 5. In the second core plate 6, the oil passage hole 11 is provided at the inner side of an outer periphery edge of the boss portion 21, as seen in a plan view. Moreover, the coolant passage hole 12 is provided at the outer side of an outer periphery edge of the boss portion 24 in the second core plate 6. Moreover, as illustrated in FIG. 3, FIG. 7 and FIG. 8, at the second core plate 6, a perimeter of the through hole 13 is formed, as a boss portion 26, so as to protrude towards the side of the oil flow path between plates 7 (upper side), where this perimeter abuts and is brazed with the boss portion 23 of the adjacent first core plate 6. The boss portion 26 is the inner periphery side of the boss portion 24, and is formed at the outer periphery side of through hole 13.

Therefore, by alternatingly combining the first core plate 5 and second core plate 6, fixed gaps which become the oil flow path between plates 7 and coolant flow path between plates 8 are formed between the first core plate 5 and second core plate 6.

The boss portion 21 provided at the perimeter of oil passage hole 11 and through hole 13 in the first core plate 5 is joined to the boss portion 24 provided at the perimeter of oil passage hole 11 and through hole 13 of the adjacent side of the second core plate 6. Two oil flow paths between plates 7 adjacent in the up/down direction thereby communicate with each other, and are isolated from the coolant flow paths between plates 8 which is between the two oil flow paths between plates 7. Accordingly, in a state of a plurality of the first core plates 5 and second core plates 6 having been joined, the oil flow paths between plates 7 each communicate with each other via the plurality of oil passage holes 11. This plurality of oil passage holes 11 constitutes an (oil) flow-through portion penetrating through the plates through which a fluid (oil) flows.

The boss portion 21 is a protruded portion which is provided by protruding from the first core plate 5 in the stacking direction: namely, any one direction of the z-axis direction, for example, the +z-axis direction (the upper side direction in the z-axis direction of the heat exchange portion 2). The boss portion 21 is a boss corresponding to the first boss portion formed so as to protrude until abutting with the adjacent second core plate 6. The boss portion 21 is formed so as to surround the boss portion 23 as a third boss portion and so as to protrude in the reverse direction to the boss portion 23. In the boss portion 21, the oil passage hole 11 provided at this boss portion 21 is adjacent to the through hole 13 provided at the boss portion 23. The boss portion 21 is also disposed adjacent to the boss portion 22. The boss portion 22 is a boss corresponding to the second boss portion formed so as to protrude until abutting with the adjacent second core plate 6. The boss portion 21 is formed in a concavo-convex shape in the cross-sectional direction of the first core plate 5. Moreover, in the boss portion 21, the edge portion protruding from the first core plate 5, as seen in a plan view of the first core plate 5, has one shape continuous with the edge portion of the boss portion 22.

The boss portion 25 provided at the perimeter of the coolant passage hole 12 in the second core plate 6 is joined to the boss portion 22 provided at the perimeter of the coolant passage hole 12 of the adjacent side of the first core plate 5. Two coolant flow paths between plates 8 adjacent in the up/down direction thereby communicate with each other, and are isolated from the oil flow paths between plates 7 which is between the two coolant flow paths between plates 8. Accordingly, in a state of a plurality of the first core plates 5 and second core plates 6 having been joined, the coolant flow paths between plates 8 each communicate with each other via a plurality of coolant passage holes 12. This plurality of coolant passage holes 12 constitutes a (coolant) flow-through portion penetrating through the plates through which a fluid (coolant) flows.

The boss portion 24 is a protruded portion which is provided by protruding in the stacking direction from the second core plate 6; namely, any one direction of the z-axis direction, for example, the −z-axis direction (the lower side direction in the z-axis direction of the heat exchange portion 2). The boss portion 24 is a boss corresponding to the first boss portion formed so as to protrude until abutting with the adjacent first core plate 5. The boss portion 24 is formed so as to surround the boss portion 26 as a third boss portion and so as to protrude in the reverse direction to the boss portion 26. The boss portion 24 is provided in a position corresponding to the boss portion 21 of the adjacent first core plate 5 in the z-axis direction. In the boss portion 24, the oil passage hole 11 is adjacent to the through hole 13 provided at the boss portion 26. The boss portion 24 is also disposed adjacent to the boss portion 25. The boss portion 25 is a boss corresponding to the second boss portion formed so as to protrude until abutting with the adjacent first core plate 5. The boss portion 24 is formed in a concavo-convex shape in the cross-sectional direction of the second core plate 6. Moreover, in the boss portion 24, the edge portion protruding from the second core plate 6, as seen in a plan view of the second core plate 6, has one shape continuous with the edge portion of the boss portion 25.

The boss portion 23 around the through hole 13 in the first core plate 5 is joined to the boss portion 26 provided at the perimeter of through hole 13 of the second core plate 6 adjacent in the up/down direction. Accordingly, in a state of a plurality of the first core plates 5 and second core plates 6 having been joined, through hole 13 does not communicate with the oil flow path between plates 7 and coolant flow path between plates 8.

As illustrated in FIG. 8, the first fin plate 9 has a substantially rectangular external shape, and comprises a pair of mutually facing longitudinal sides 9*a* and a pair of mutually facing lateral sides 9*b*.

The first fin plate 9 is joined, by a suitable method such as brazing, to flat portions in the second core plate 6 where boss portions 24, 25, 26 etc. are not provided. As illustrated in FIG. 9, the first fin plate 9 is formed by means of a fin plate main body 91 which is formed by a member with high thermal conductivity such as a sheet-like member made of aluminum. In the first fin plate 9, by bending the fin plate main body 91 by means of a suitable method such as bend working, fins are formed. In these fins, protruded portions 92 and recessed portions 93 extending in the first direction (y-direction) are alternatingly provided towards the second direction (x-direction). Moreover, in the first fin plate 9, recessed portions 94 and protruded portions 95, which are formed by press working etc. at the side surfaces of the fins in the fin plate main body 91, are alternatingly formed towards the first direction (y-direction).

In a plan view, the first fin plate 9 has an anisotropy such that the flow path resistance in the direction parallel to the y-axis direction is less than the flow path resistance in the direction parallel to the x-axis direction. In other words, the first fin plate 9 has an anisotropy such that the flow path resistance in the direction parallel to the lateral side 9*b* is greater than the flow path resistance in the direction parallel to the longitudinal side 9*a*. In the oil flow path between plates 7, the first fin plate 9 is disposed so as to be in contact with both sides of a set of an adjacent pair of plates (first core plate 5 and second core plate 6) which demarcate the oil flow path between plates 7 between one set of oil passage holes 11.

As illustrated in FIG. 5, the second fin plate 10 has a substantially rectangular external shape, and comprises a pair of mutually facing longitudinal sides 10*a* and a pair of mutually facing lateral sides 10*b*.

The second fin plate 10 is joined, by a suitable method such as brazing, to flat portions in the first core plate 5 where boss portions 21, 22, 23 etc. are not provided, and is positioned in the y-direction by a plurality of embossments 117 formed at the first core plate 5. As illustrated in FIG. 6, the second fin plate 10 is formed by means of a fin plate main body 101 which is formed by a member with high thermal conductivity such as a sheet-like member made of aluminum. In the second fin plate 10, by bending the fin plate main body 101 by means of a suitable method such as bend working, fins are formed. In these fins, protruded portions 102 and recessed portions 103 extending in the first direction (y-direction) are alternatingly provided towards the second direction (x-direction). Moreover, in the second fin plate 10, recessed portions 104 and protruded portions 105 which are formed by press working etc. at the side surfaces of the fins in the fin plate main body 101, are alternatingly formed towards the first direction (y-direction).

In a plan view, the second fin plate 10 has an anisotropy such that the flow path resistance in the direction parallel to the y-axis direction is less than the flow path resistance in the direction parallel to the x-axis direction. In other words, the second fin plate 10 has an anisotropy such that the flow path resistance in the direction parallel to the lateral side 10*b* is greater than the flow path resistance in the direction parallel to the longitudinal side 10*a*. In the coolant flow path between plates 8, the second fin plate 10 is disposed so as to be in contact with both sides of a set of an adjacent pair of plates (first core plate 5 and second core plate 6) which demarcate the coolant flow path between plates 8 between one set of coolant passage holes 12.

At the first core plate 5, an edge portion 27 is provided at the boss portion 21. The edge portion 27 functions as a second edge portion in contact with the coolant configured as a second fluid. The edge portion 27 is provided at the part of the boss portion 21 facing towards the central side of the first core plate 5; in other words, at the part facing the second fin plate 10. As illustrated in FIG. 5, the edge portion 27 is formed so as to extend in the x-axis direction (left-right direction); in other words, in the second direction. The edge portion 27 is formed such that a gap with the second fin plate 10 is narrowed in the second direction towards the end portion of the first core plate 5 in the left-right direction. As seen in a plan view here, the edge portion 27 is provided so as to have an angle (have a slant) with respect to a standing wall portion 116 which corresponds to a side of the first core plate 5 which is formed in a substantially rectangular shape.

Because the edge portion 27 comprises the above shape, the flow of coolant from one side of the coolant passage hole 12 towards the other side of the coolant passage hole 12 on the first core plate 5 in the heat exchange portion 2, seeps into the second fin plate 10 whilst spreading towards the second direction (x-direction) of the coolant flow path between plates 8 following along one side of edge portion 27, as illustrated by arrow marks L11A, L11B, L11C in FIG. 5. The coolant having seeped into the second fin plate 10 in the first core plate 5 flows in the first direction (y-direction) following along the fins, and flows towards the other side of the coolant passage hole 12 whilst partially following along the other side of edge portion 27. In other words, according to the oil cooler 1, because the first core plate 5 comprises the edge portion 27, coolant can be made to spread onto the entire surface of the second fin plate 10. Moreover, the flow of coolant through the second fin plate 10 can be guided to the other side of the coolant passage hole 12.

At the second core plate 6, an edge portion 28 is provided at the boss portion 25. The edge portion 28 functions as a first edge portion in contact with the oil configured as a first fluid. The edge portion 28 is provided at the part of the boss portion 25 facing towards the central side of the second core plate 6; in other words, at the part facing the first fin plate 9. As illustrated in FIG. 8, edge portion 28 is formed so as to extend in the x-axis direction (left-right direction); in other words, in the second direction. The edge portion 28 is formed such that a gap with the first fin plate 9 is narrowed in the second direction towards the end portion of the plate in the left-right direction. As seen in a plan view here, the edge portion 28 is provided so as to have an angle (have a slant) with respect to a standing wall portion 126 which corresponds to a side of the second core plate 6 which is formed in a substantially rectangular shape. In other words, as seen in a plan view of the second core plate 6 as illustrated in FIG. 8, the edge portion 28 has a prescribed angle with respect to a straight line extending in the second direction (x-direction) which is at a right angle to the first direction, which is the direction of the flow of oil.

Because the edge portion 28 comprises the above shape, the flow of oil flowing through the oil flow path between plates 7, from one side of oil passage hole 11 towards the other side of oil passage hole 11 on the second core plate 6 in the heat exchange portion 2, is as illustrated by arrow marks L21A, L21B, L21C in FIG. 8. The flow of oil from one side of oil passage hole 11 towards the other side of oil passage hole 11 seeps into the first fin plate 9 whilst spreading towards the second direction (x-direction) of the oil flow path between plates 7 following along one side of the boss portion 26 and edge portion 28. The oil having seeped into the first fin plate 9 in the second core plate 6 flows in the first direction (y-direction) following along the fins, and flows towards the other side of oil passage hole 11 whilst partially following along the other side of the edge portion 28 and the boss portion 26. In other words, according to the oil cooler 1, because the second core plate 6 comprises edge portion 28, oil can be made to spread onto the entire surface of the first fin plate 9. Moreover, the flow of oil through the first fin plate 9 can be guided to the other side of the oil passage hole 11.

Furthermore, the back surface side (recessed portion side) of the boss portion 24 also functions as an oil pathway. A pathway space, sandwiched between the back surface side of edge portion 27A of the boss portion 24 and edge portion 26A formed by the boss portion 26, is also formed such that the respective edge portions are relatively angled, which similarly contributes to the spreading of oil.

In the oil cooler 1 configured as in the above, the boss portion 21 and the boss portion 24, which are formed surrounding the through hole 13 and oil passage hole 11, are brazed. Thus, when the first and second core plates 5, 6 are brazed, a large brazing area can be ensured by the boss portions 21, 24 (first boss portions), because the boss portions 21, 24 which have a large contour and a large area. Further, in the coolant flow path between plates 8, the space can be eliminated between the first and second core plates 5, 6 adjacent in the stacking direction between the boss portions 21, 24. Because plate deformation due to fluid pressure occurs due to a fluid pressure difference of the coolant and oil, countermeasures are especially needed when the pressure on the oil side becomes high and the pressure differential becomes large. However, in this oil cooler 1, because the space between the first and second core plate 5, 6 (coolant flow path between plates 8) does not exist at the positions of the boss portions 21, 24, a pressure differential between the oil and coolant does not occur. Therefore, even if the oil pressure becomes high, there is no deformation due to the oil pressure being applied to the plate flat portion of the perimeter of the oil passage hole 11. Furthermore, the portion where the first boss portions were brazed have a plate thickness of two overlapping plates, hence the strength of the perimeters of oil passage hole 11 and through hole 13, which are fluid ports, can be improved. Moreover, as illustrated in FIG. 5 and FIG. 8, the coolant passage hole 12 and boss portions 22, 25 (second boss portions) have a long, substantially elliptical shape in the x-direction, and thus the coolant passage hole 12 has a sufficient opening area and the brazing area around the port can be ensured. Hence, the brazing strength of the perimeter of the coolant passage hole 12, which is a fluid port, can be improved. Moreover, the boss portions 21, 24 and the boss portions 22, 25 are continuous, as seen in a plan view, and the plate flat portion of the perimeter of a fluid port can be eliminated, hence the strength of a heat exchanger can be better improved.

Moreover, boss portions 23, 26 (third boss portions) of the perimeter of the through hole 13 are formed so as to protrude until abutting with an adjacent plate in the reverse direction to the boss portions 21, 24. Thus, because the boss portions 23, 26 are coupled in the stacking direction and a columnar structure is formed in the oil flow path between plates 7, the perimeter of the oil passage hole 11 adjacent to the through hole 13 is supported and the deformation strength can be raised.

Accordingly, according to the oil cooler 1 thereby configured, the rigidity of the perimeter of the fluid port portion outside the first fin plate 9 and the second fin plate 10 can be improved, and thus plate deformation due to expansion of the heat exchanger can be suppressed when internal pressure occurring inside the heat exchanger rises, and the strength of oil cooler 1 as a whole can be improved.

Although the embodiment of the present invention is explained as above, the present invention is not limited to the heat exchanger according to the aforementioned embodiment of the present invention, and includes any mode encompassed in the concept and claims of the present invention. Moreover, the constituents may be suitably and selectively combined so as to exhibit at least a portion of the aforementioned object and effect. For example, shapes, materials, arrangements and sizes etc. of the constituents in the aforementioned embodiment may be suitably changed depending on the specific mode of use of the present invention.

In the oil cooler 1, an example was explained in which the flow-through portion provided at the boss portion 21 and the boss portion 24 which surround the boss portion 23 and the boss portion 26, is the oil passage hole 11, for example. However, there is no limitation on the type of fluid flowing through the flow-through portion.

The invention claimed is:

1. A heat exchanger, comprising:

a plurality of plates stacked on one another in a stacking direction;

a plurality of oil flow paths and a plurality of coolant flow paths disposed in an alternating manner in the stacking direction, each of the plurality of oil flow paths and each of the plurality of coolant flow paths defined by a respective pair of adjacent plates of the plurality of plates;

each plate of the plurality of plates including:

a plurality of oil passage holes including a first oil passage hole and a second oil passage hole disposed on opposite sides of the respective plate and between which one of the plurality of oil flow paths extends;

a plurality of coolant passage holes including a first coolant passage hole and a second coolant passage hole disposed on opposite sides of the respective plate and between which one of the plurality of coolant flow paths extends;

a plurality of through holes including (i) a first through hole disposed in the respective plate between the first oil passage hole and the first coolant passage hole and (ii) a second through hole disposed in the respective plate between the second oil passage hole and the second coolant passage hole;

a main plate portion;

a boss portion protruding from the main plate portion and surrounding (i) the first through hole and (ii) one of the first oil passage hole and the first coolant passage hole; and another boss portion protruding from the boss portion and surrounding the first through hole;

wherein the plurality of oil flow paths fluidically communicate with one another in the stacking direction via the plurality of oil passage holes;

wherein the plurality of coolant flow paths fluidically communicate with one another in the stacking direction via the plurality of coolant passage holes;

wherein the boss portion and the another boss portion protrude in opposite directions;

wherein the boss portion of each plate of the plurality of plates abuts the boss portion of an adjacent plate of the plurality of plates;

wherein the another boss portion of each plate of the plurality of plates abuts the another boss portion of an adjacent plate of the plurality of plates;

wherein the main plate portion of each plate of the plurality of plates is a flat, planar portion oriented perpendicularly to the stacking direction; and wherein the main plate portion of each plate of the plurality of plates is rectangular.

2. The heat exchanger according to claim 1, wherein the first oil passage hole, the second oil passage hole, the first coolant passage hole, and the second coolant passage hole are each arranged proximal a different corner of the main plate portion of the respective plate.

3. The heat exchanger according to claim 1, wherein:

the boss portion of each plate of the plurality of plates is brazed to the abutting boss portion of the adjacent plate of the plurality of plates; and/or the another boss portion of each plate of the plurality of plates is brazed to the abutting another boss portion of the adjacent plate of the plurality of plates.

4. The heat exchanger according to claim 1, further comprising a plurality of fin plates disposed in the plurality of oil flow paths and the plurality of coolant flow paths.

5. The heat exchanger according to claim 4, wherein each fin plate of the plurality of fin plates is brazed to a respective pair of plates of the plurality of plates that are disposed adjacent thereto.

6. The heat exchanger according to claim 4, wherein the plurality of fin plates includes:

a plurality of first fin plates that are each disposed in a respective oil flow path of the plurality of oil flow paths; and a plurality of second fin plates that are each disposed in a respective coolant flow path of the plurality of coolant flow paths.

7. The heat exchanger according to claim 1, wherein the boss portion surrounds the first through hole and the first oil passage hole, and does not surround the first coolant passage hole.

8. The heat exchanger according to claim 7, wherein the boss portion and the first coolant passage hole each have an elongated shape.

9. The heat exchanger according to claim 8, wherein an elongated extent of the boss portion and an elongated extent of the first coolant passage hole extend substantially parallel to one another.

10. The heat exchanger according to claim 7, wherein:

each plate of the plurality of plates further includes an additional boss portion protruding from the main plate portion and surrounding the first coolant passage hole; and the boss portion and the additional boss portion protrude from the main plate portion in opposite directions.

11. The heat exchanger according to claim 10, wherein the additional boss portion of each plate of the plurality of plates abuts the additional boss portion of an adjacent plate of the plurality of plates.

12. The heat exchanger according to claim 11, wherein the additional boss portion of each plate of the plurality of plates is brazed to the abutting additional boss portion of the adjacent plate of the plurality of plates.

13. The heat exchanger according to claim 7, wherein the boss portion is continuous and completely surrounds the first through hole and the first oil passage hole such that no portion of the main plate portion is disposed between the first through hole and the first oil passage hole.

14. The heat exchanger according to claim 1, wherein:

the boss portion and the another boss portion are arranged on a first side of the respective plate;

each plate of the plurality of plates further includes:

a second-side boss portion arranged on a second side of the respective plate opposite the first side, the second-side boss portion protruding from the main plate portion and surrounding (i) the second through hole and (ii) one of the second oil passage hole and the second coolant passage hole; and another second-side boss portion arranged on the second side of the respective plate, the another second-side boss portion protruding from the second-side boss portion and surrounding the second through hole;

the second-side boss portion and the another second-side boss portion protrude in opposite directions;

the second-side boss portion of each plate of the plurality of plates abuts the second-side boss portion of an adjacent plate of the plurality of plates; and the another second-side boss portion of each plate of the plurality of plates abuts the another second-side boss portion of an adjacent plate of the plurality of plates.

15. The heat exchanger according to claim 14, wherein:

the boss portion surrounds the first through hole and the first oil passage hole, and does not surround the first coolant passage hole; and the second-side boss portion surrounds the second through hole and the second oil passage hole, and does not surround the second coolant passage hole.

16. The heat exchanger according to claim 15, wherein:

each plate of the plurality of plates further includes:

an additional boss portion disposed on the first side of the respective plate, the additional boss portion protruding from the main plate portion and surrounding the first coolant passage hole; and an additional second-side boss portion disposed on the second side of the respective plate, the additional second-side boss portion protruding from the main plate portion and surrounding the second coolant passage hole;

the boss portion and the additional boss portion protrude from the main plate portion in opposite directions; and the second-side boss portion and the additional second-side boss portion protrude from the main plate portion in opposite directions.

17. The heat exchanger according to claim 16, wherein the first oil passage hole, the second oil passage hole, the first coolant passage hole, and the second coolant passage hole are each arranged proximal a different corner of the main plate portion of the respective plate.

18. A heat exchanger, comprising:

a plurality of plates stacked on one another in a stacking direction;

a plurality of oil flow paths and a plurality of coolant flow paths disposed in an alternating manner in the stacking direction, each of the plurality of oil flow paths and each of the plurality of coolant flow paths defined by a respective pair of adjacent plates of the plurality of plates;

each plate of the plurality of plates including:

a plurality of oil passage holes including a first oil passage hole and a second oil passage hole disposed on opposite sides of the respective plate and between which one of the plurality of oil flow paths extends;

a plurality of coolant passage holes including a first coolant passage hole and a second coolant passage hole disposed on opposite sides of the respective plate and between which one of the plurality of coolant flow paths extends;

a plurality of through holes including (i) a first through hole disposed in the respective plate between the first oil passage hole and the first coolant passage hole and (ii) a second through hole disposed in the respective plate between the second oil passage hole and the second coolant passage hole;

a main plate portion structured as a flat, planar portion oriented perpendicularly to the stacking direction;

a first boss portion, a second boss portion, and a third boss portion arranged on a first side of the main plate portion;

the first boss portion protruding from the main plate portion and surrounding (i) the first through hole and (ii) the first oil passage hole;

the second boss portion protruding from the main plate portion and surrounding the first coolant passage hole; and the third boss portion protruding from the first boss portion and surrounding the first through hole;

wherein the plurality of oil flow paths fluidically communicate with one another in the stacking direction via the plurality of oil passage holes;

wherein the plurality of coolant flow paths fluidically communicate with one another in the stacking direction via the plurality of coolant passage holes;

wherein the first boss portion protrudes in an opposite direction than second boss portion and the third boss portion;

wherein the first boss portion of each plate of the plurality of plates abuts the first boss portion of an adjacent plate of the plurality of plates; and wherein the third boss portion of each plate of the plurality of plates abuts the third boss portion of an adjacent plate of the plurality of plates.

19. The heat exchanger according to claim 18, wherein:

each plate of the plurality of plates further includes a first second-side boss portion, a second second-side boss portion, and a third second-side boss portion arranged on a second side of the main plate portion opposite the first side;

the first second-side boss portion protrudes from the main plate portion and surrounds (i) the second through hole and (ii) the second oil passage hole;

the second second-side boss portion protrudes from the main plate portion and surrounds the second coolant passage hole;

the third second-side boss portion protrudes from the first second-side boss portion and surrounds the second through hole;

the first second-side boss portion protrudes in an opposite direction than the second second-side boss portion and the third second-side boss portion;

the first second-side boss portion of each plate of the plurality of plates abuts the first second-side boss portion of an adjacent plate of the plurality of plates; and the third second-side boss portion of each plate of the plurality of plates abuts the third second-side boss portion of an adjacent plate of the plurality of plates.

20. A heat exchanger, comprising:

a plurality of plates stacked on one another in a stacking direction;

a plurality of oil flow paths and a plurality of coolant flow paths disposed in an alternating manner in the stacking direction, each of the plurality of oil flow paths and each of the plurality of coolant flow paths defined by a respective pair of adjacent plates of the plurality of plates;

each plate of the plurality of plates including:

a plurality of oil passage holes including a first oil passage hole and a second oil passage hole disposed on opposite sides of the respective plate and between which one of the plurality of oil flow paths extends;

a plurality of coolant passage holes including a first coolant passage hole and a second coolant passage hole disposed on opposite sides of the respective plate and between which one of the plurality of coolant flow paths extends;

a plurality of through holes including (i) a first through hole disposed in the respective plate between the first oil passage hole and the first coolant passage hole and (ii) a second through hole disposed in the respective plate between the second oil passage hole and the second coolant passage hole;

a main plate portion;

a standing wall portion projecting obliquely from the main plate portion and extending along an outer perimeter of the main plate portion;

a boss portion protruding from the main plate portion and surrounding (i) the first through hole and (ii) one of the first oil passage hole and the first coolant passage hole; and another boss portion protruding from the boss portion and surrounding the first through hole;

wherein the plurality of oil flow paths fluidically communicate with one another in the stacking direction via the plurality of oil passage holes;

wherein the plurality of coolant flow paths fluidically communicate with one another in the stacking direction via the plurality of coolant passage holes;

wherein the boss portion and the another boss portion protrude in opposite directions;

wherein the boss portion of each plate of the plurality of plates is disposed spaced apart from the standing wall portion and abuts the boss portion of an adjacent plate of the plurality of plates; and wherein the another boss portion of each plate of the plurality of plates abuts the another boss portion of an adjacent plate of the plurality of plates.

* * * * *